US010435855B1

(12) United States Patent
Cohen

(10) Patent No.: US 10,435,855 B1
(45) Date of Patent: Oct. 8, 2019

(54) MAGNETIC STANCHION CONNECTOR ASSEMBLY

(71) Applicant: Andrew Baxter Cohen, Fort Lauderdale, FL (US)

(72) Inventor: Andrew Baxter Cohen, Fort Lauderdale, FL (US)

( * ) Notice: Subject to any disclaimer, the term of this patent is extended or adjusted under 35 U.S.C. 154(b) by 0 days.

(21) Appl. No.: 16/510,904

(22) Filed: Jul. 13, 2019

(51) Int. Cl.
*E01F 13/02* (2006.01)

(52) U.S. Cl.
CPC ..... *E01F 13/022* (2013.01)

(58) Field of Classification Search
CPC ..... E01F 13/02; E01F 13/022; E01F 13/028; E01F 13/04
See application file for complete search history.

(56) References Cited

U.S. PATENT DOCUMENTS 4,844,420 A 7/1989 Oster
4,858,551 A 8/1989 Peters
5,758,868 A * 6/1998 Shea ..... E01F 7/02 256/12.5
6,375,164 B1 * 4/2002 Siegler ..... E01F 13/028 256/1
6,485,225 B1 11/2002 Baker
6,776,398 B1 * 8/2004 Tsai ..... E01F 13/028 256/37
6,830,236 B2 * 12/2004 Augusto de Lorenzo ..... E01F 13/028 256/1
7,909,310 B2 * 3/2011 Weiner ..... E01F 13/028 256/45
8,118,250 B1 2/2012 Helseth et al.
8,308,393 B2 * 11/2012 Jette ..... E06B 11/085 404/10
8,707,595 B2 4/2014 Beemsterboer et al.
9,175,450 B2 11/2015 Weiner
9,890,506 B2 * 2/2018 Weiner ..... E01F 13/028
10,035,677 B2 7/2018 Chen et al.
2002/0063248 A1 * 5/2002 Siegler ..... E01F 13/028 256/37
2003/0111657 A1 * 6/2003 Green ..... A47F 10/00 256/45
2005/0017115 A1 * 1/2005 de Lorenzo ..... E01F 13/028 242/378.4
2010/0181030 A1 * 7/2010 Smoyer ..... A47G 5/02 160/290.1
2010/0314480 A1 * 12/2010 Gallacher ..... B65H 75/446 242/379

(Continued)

*Primary Examiner* — Daniel J Wiley
(74) *Attorney, Agent, or Firm* — Mark C. Johnson; Johnson |Dalal

(57) ABSTRACT

A magnetic stanchion connector assembly that includes a first stanchion connector and a second stanchion connector, wherein the first and second stanchion connectors each have a rear face operably configured to selectively removably couple with a belt connector and a second belt connector of a stanchion connection assembly in stanchion tongue-and-groove locking configuration. The first and second stanchion connectors each have a magnet retained thereon of opposite polarities and disposed proximal to a front face of each stanchion connector, wherein the first and second stanchion connectors are operably configured to magnetically couple together quickly and effectively and adapted for use with conventional belt connectors on a stanchion connection assembly.

19 Claims, 5 Drawing Sheets

(56) References Cited

U.S. PATENT DOCUMENTS

| | | | | |
|---|---|---|---|---|
| 2012/0234990 | A1* | 9/2012 | Lewis | E01F 13/028 248/122.1 |
| 2015/0114308 | A1 | 4/2015 | Dolphin | |
| 2015/0137057 | A1* | 5/2015 | Weiner | E01F 13/028 256/40 |
| 2016/0047953 | A1 | 2/2016 | Crawley | |
| 2016/0244923 | A1 | 8/2016 | Green | |
| 2017/0167093 | A1* | 6/2017 | Punzengruber | E01F 13/028 |
| 2018/0170709 | A1* | 6/2018 | Chen | E01F 13/028 |

* cited by examiner

100

MAGNETIC STANCHION CONNECTOR ASSEMBLY

FIELD OF THE INVENTION

The present invention relates generally to stanchions, and, more particularly, relates selectively removable connectors for stanchions.

BACKGROUND OF THE INVENTION

Stanchions generally consist of an upright bar or post that includes one or more extendable and retractable belts, velvet ropes, plastic chains. In some instances, stanchions are utilized in conjunction with wall-mounted barrier devices, barricades, and printed signage. Stanchions are often used by users for crowd control, engineering or directing the flow of foot traffic, and construction site safety. However, stanchions are used for many different purposes, including crowd control and waiting lines. Many different places use stanchions, including airports, banks, stores, hotels, museums, restaurants, concert venues, trade shows, and other events. Stanchions have become a more prevalent and effective solution to managing crowd control than, for example, using stickers, signs, or cones.

Whether it is from repeated use or mishandling, many stanchion belts become inadvertently or intentionally dislodged and/or removed from a pole to which it is configured to be connected, thereby minimizing the effectiveness and/or purpos(es) of the stanchions. In many instances, the connectors on the stanchion belts and poles become damaged and do not function properly from the repeated use or mishandling. Some known solutions to address this problem include utilizing one or more mechanical fasteners configured to retain the stanchion belt end to a stanchion pole member. Using mechanical fasteners, however, makes connecting and disconnecting the stanchion belts more time consuming, which many users find problematic. The use of mechanical fasteners also increases the likelihood of damaging the belt end or the pole member to which is configured to be coupled.

Therefore, a need exists to overcome the problems with the prior art as discussed above and to provide a versatile, effective, and adaptable solution to couple stanchion poles together with a rope, cable, belt, or the like.

SUMMARY OF THE INVENTION

The invention provides a magnetic stanchion connector assembly that overcomes the hereinafore-mentioned disadvantages of the heretofore-known devices and methods of this general type and that effectively, efficiently, and quickly facilitates in the quick removal and attachment of stanchion poles together. More specifically, the stanchion connector employs the use of magnet adapters operably configured to selectively coupled and uncouple to a rope end and a stanchion rope receiving end. In a principal embodiment, the connection means is operable to retrofit with a conventional stanchion means. The product would come in two pieces that are magnetized together in the middle. One would securely clip onto the male end of the stanchion rope, and one would securely clip on to the female end defined by the stanchion. The two pieces would each have magnets in the contact point in order to securely lock it. There will be a groove on the vertical edges of one of the pieces, in order to ensure a snug contact.

With the foregoing and other objects in view, there is provided, in accordance with the invention, a magnetic stanchion connector assembly utilized in connection with a stanchion connection assembly having an upright first stanchion pole member with a belt with an end having a belt connector disposed thereon that is operably configured to selectively extend and retract with respect to the upright first stanchion pole member and a second stanchion pole member with a second belt connector disposed thereon. The belt connector and the second belt connector are operably configured to selectively directly couple together in a stanchion tongue-and-groove locking configuration. The magnetic stanchion connector assembly includes a first stanchion connector having an upper end, a lower end, a connector length separating the upper and lower ends of the first stanchion connector, a rear end with a rear face disposed thereon and with a rear adaptor connector of a male configuration including a locking member disposed on the rear face and spanning along the connector length. The first stanchion connector has a front end with a front face opposing the rear face of the first stanchion connector and with a first magnet retained by the first stanchion connector and disposed proximal to, and with a first pole facing in a direction toward, the front face of the first stanchion connector. The magnetic stanchion connector assembly also includes a second stanchion connector having an upper end, a lower end, a connector length separating the upper and lower ends of the second stanchion connector, a rear end with a rear face disposed thereon and with a rear adaptor connector of a female configuration including a channel disposed on the rear face, corresponding in shape to the locking member of the first stanchion connector, and spanning along the connector length of the second stanchion connector. The second stanchion connector includes a front end with a front face opposing the rear face of the second stanchion connector and with a second magnet retained by the second stanchion connector and disposed proximal to, and with a second pole facing in a direction toward, the front face of the second stanchion connector. The first and second poles of the first and second magnets, respectively, are of an opposite polarity and the rear adaptor connectors of the first and second stanchion connectors operably configured to selectively directly couple together in a stanchion tongue-and-groove locking configuration.

Said another way, the first stanchion connector has a rear end with a rear face disposed thereon and with a rear adaptor connector operably configured to selectively and removably directly couple with the belt connector and has a front end with a front face opposing the rear face of the first stanchion connector and with a first magnet retained by the first stanchion connector disposed proximal to, and with a first pole facing in a direction toward, the front face of the first stanchion connector. The second stanchion connector has a rear end with a rear face disposed thereon and with a rear adaptor connector operably configured to selectively and removably directly couple with the second belt connector and has a front end with a front face opposing the rear face of the second stanchion connector and with a second magnet retained by the second stanchion connector and disposed proximal to, and with a second pole facing in a direction toward, the front face of the second stanchion connector. The rear adaptor connectors of the first and second stanchion connectors are operably configured to selectively directly couple together in the stanchion tongue-and-groove locking configuration and the first and second poles of the first and second magnets, respectively, are of an opposite polarity.

In accordance with another feature, an embodiment of the present invention includes the belt connector of a female configuration and the second belt connector of a male configuration and the rear adaptor connector of the first stanchion connector of a male configuration corresponding to the female configuration of the belt connector and the rear adaptor connector of the second stanchion connector of a female configuration corresponding to the male configuration of the second belt connector.

In accordance with a further feature of the present invention, the stanchion tongue-and-groove configuration is of a slidable configuration.

In accordance with yet another feature of the present invention, the first and second magnets are of a neodymium material. Additionally, the first and second magnets each have a magnetic flux density of approximately 0.1-1.5 Tesla.

In accordance with a further feature of the present invention, the front faces on the front ends of the first and second stanchion connectors are each substantially planar. Additionally, the front faces on the front ends of the first and second stanchion connectors are each respectively defined by an outermost terminal perimeter end surface on the front end.

In accordance with an additional feature, an embodiment of the present invention also includes the first and second stanchion connectors having a cavity with first and second magnets, respectively, at least partially housed therein and a face plate defining the front face on each of the first and second stanchion connectors and superimposing the cavity and housed magnet thereon.

In accordance with an exemplary feature of the present invention, the face plate is of a U-shaped configuration selectively removably coupled to the front end of each of the first and second stanchion connectors with a plurality of mechanical fasteners, the face plate having at least one channel spanning a face plate length of the face plate.

In accordance with an additional feature, an embodiment of the present invention also includes the first magnet being an electromagnet and the first stanchion connector having a power source and a switch operably configured to have a first position along a switch translation path completing a circuit and electrically coupling the power source with the electromagnet and a second position along the switch translation path electrically uncoupling the power source with the electromagnet, wherein the power source is of a lithium ion battery. In additional embodiments, the second magnet is a permanent magnet.

Although the invention is illustrated and described herein as embodied in a magnetic stanchion connector assembly, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time. Also, for purposes of description herein, the terms "upper", "lower", "left," "rear," "right," "front," "vertical," "horizontal," and derivatives thereof relate to the invention as oriented in the figures and is not to be construed as limiting any feature to be a particular orientation, as said orientation may be changed based on the user's perspective of the device. Furthermore, there is no intention to be bound by any expressed or implied theory presented in the preceding technical field, background, brief summary or the following detailed description.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the extension and retraction of a stanchion rope or cable.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
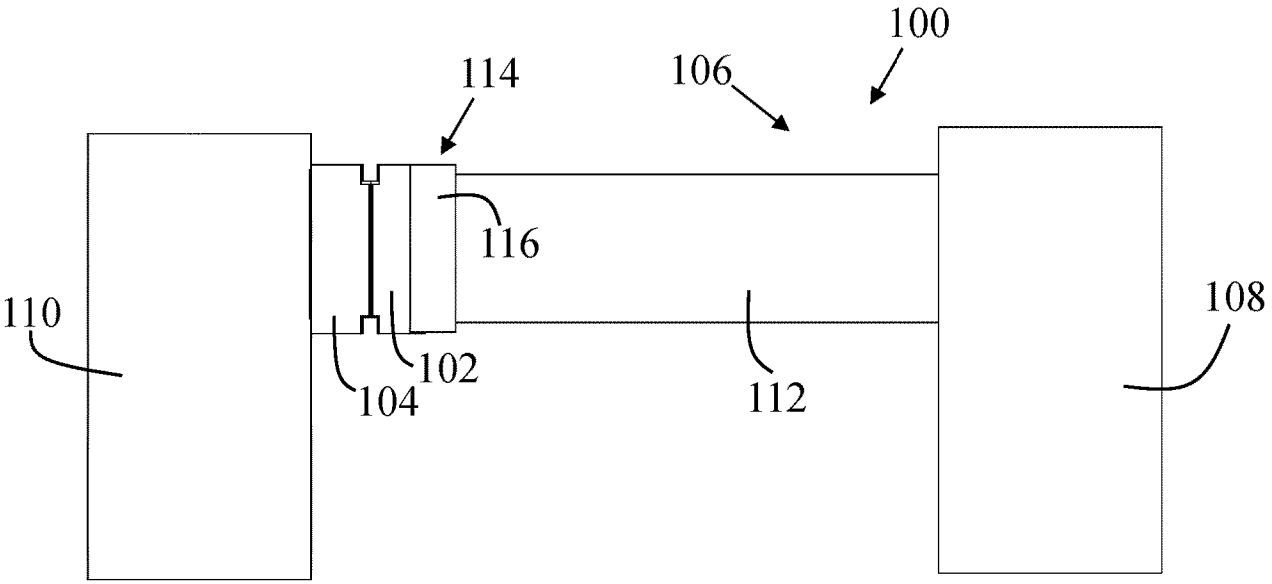
FIG. 1 is an elevational side view of a magnetic stanchion connector assembly coupled to one another and belt connectors of a stanchion connection assembly in accordance with one embodiment of the present invention.
Figure 2:
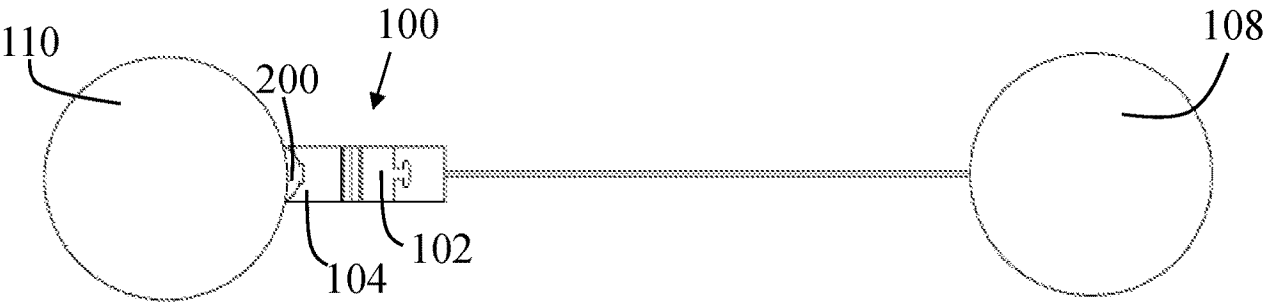
FIG. 2 is a top plan view of the stanchion connection assembly and magnetic stanchion connector assembly in FIG. 1.
Figure 3:
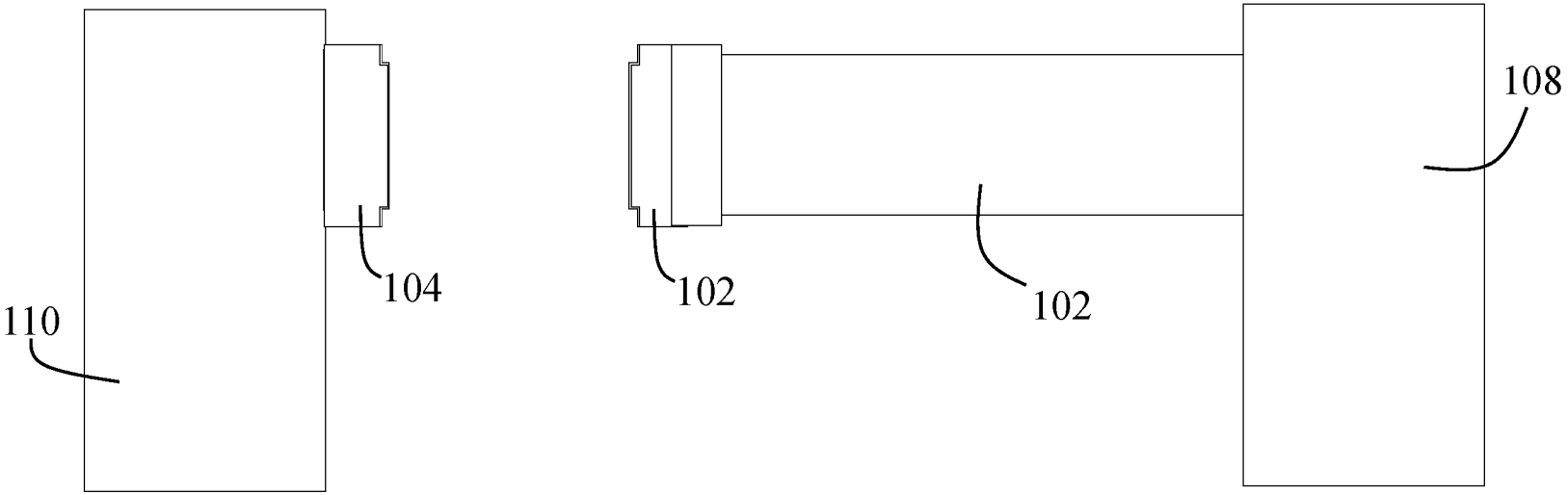
FIG. 3 is an elevational side view of a magnetic stanchion connector assembly uncoupled to one another and coupled to belt connectors of a stanchion connection assembly in accordance with one embodiment of the present invention.
Figure 4:
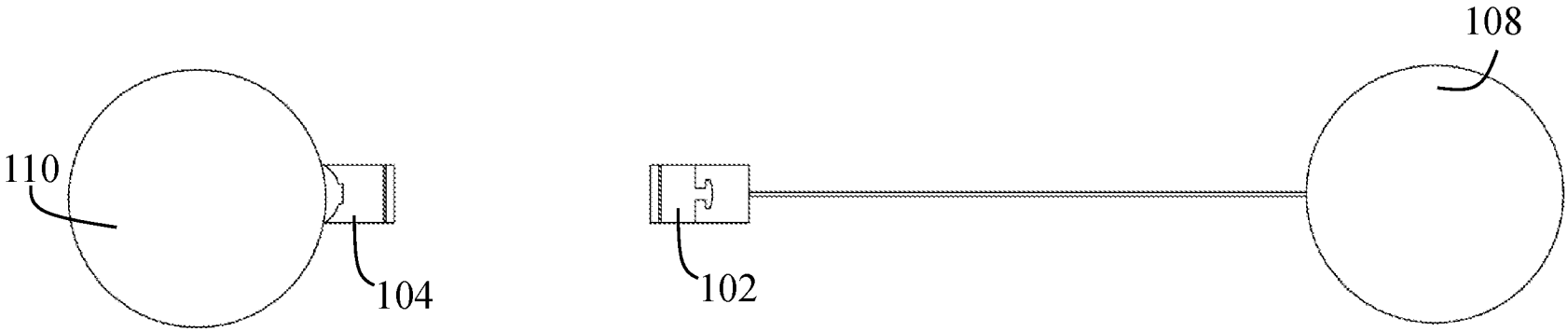
FIG. 4 is a top plan view of the stanchion connection assembly and magnetic stanchion connector assembly in FIG. 2.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

Referring now to FIGS. 1-5, one embodiment of the present invention is shown in various views. The figures show several advantageous features of the present invention, but, as will be described below, the invention can be provided in several shapes, sizes, combinations of features and components, and varying numbers and functions of the components. The first example of a magnetic stanchion connector assembly 100 includes a first stanchion connector 102 and a second stanchion connector 104. The first and second stanchion connectors are operably configured to magnetically couple together quickly and effectively, in addition to being adapted for coupling with conventional belt connectors on a stanchion connection assembly. Said differently, the belt connector 116 is of a female configuration and the second belt connector 200 is of a male configuration, wherein the rear adaptor connector 604 of the first stanchion connector 102 is of a male configuration corresponding to the female configuration of the belt connector 116 and the rear adaptor connector 610 of the second stanchion connector 104 is of a female configuration corresponding to the male configuration of the second belt connector 200. As such, the magnetic stanchion connector assembly 100 can be retrofit on any preexisting stanchion connection assembly 106.

More specifically, the stanchion connection assembly 106 may include upright first and second stanchion pole members 108, 110. The first and second stanchion pole members 108, 110 are upright in that they typically extend upwardly from a ground surface on which they rest. The first and second stanchion pole members 108, 110 may also be coupled to a wall surface or have another orientation and/or placement position. The first stanchion pole member 108 includes a belt 112 with an end 114 having a belt connector 116 disposed thereon that is operably configured to selectively extend and retract with respect to the upright first stanchion pole member 108. The belt 112 may include a rope, cable, belt, or the like, but is typically utilized as a substantially planar fabric belt. The belt 112 may be retractable and extendable using a spring-loaded reel assembly incorporated into the pole member 108. The second stanchion pole member 110 also includes a second belt connector 200 disposed thereon. The belt connector 116 and the second belt connector 200 are operably configured to selectively directly couple together in a stanchion tongue-and-groove locking configuration. Said another way, the belt connector 116 and the second belt connector 200 have a shape, size, and/or configuration that allows them to directly couple together and be prevented from uncoupling in a longitudinal direction. As those of skill in the art will appreciate, many pole members will have both types of belt connectors 116, 200 disposed thereon to allow multiple pole members to be coupled together as desired by a user.

With reference to FIG. 1 and FIGS. 5-8, the first stanchion connector 102 has an upper end 800, a lower end 802, and a connector length 804 separating the upper and lower ends 800, 802 of the first stanchion connector 102. The connector length 804 may be approximately 2-5 inches, or another length. The first stanchion connector 102 also includes a rear end 600 with a rear face 602 disposed thereon. The rear face 602 is the outermost surface located at the rear end 600. The rear end 600 also includes a rear adaptor connector 604 of a male configuration with a locking member 606 that is configured to be inserted into the belt connector 116. The locking member 606 is disposed on the rear face 602 and may span along the connector length 804. In other embodiments, the locking member 606 spans substantially the entire connector length 804. The locking member 606 may be of a T-shape and may span from the upper end 800 to the lower end 802 of the connector 102, or longitudinal direction of the connector 102. The locking member 606 may also be of another shape, e.g., a V-shape. The first stanchion connector 102 also has a front end 604 with a front face 812, opposing the rear face 602 of the first stanchion connector 102.

Similarly, the second stanchion connector 104 has many of the same features and configurations as the first stanchion connector 102, with the principal exception of the rear end 608 and configuration thereon in order to join with the belt connector 200. More specifically, the second stanchion connector 104 includes an upper end 806, a lower end 808, and a connector length 810 separating the upper and lower ends 806, 808 of the second stanchion connector 104. The second stanchion connector 104 also has rear end 608 with a rear face 700 disposed thereon. The second stanchion connector 104 also includes a rear adaptor connector 610 of a female configuration that may include a channel 702 disposed on the rear face 702 and that may also span the connector length 810.

In one embodiment, the channel 702 may be of uniform rectangular width spanning the entire connector length 810 and may correspond in shape, but is slightly larger than, the locking member 606. Said another way, the channel 702 is shaped and sized to receive the locking member 606. In one embodiment, the channel 702 is only accessible from either the upper end 806 or the lower 808 of the connector 104, i.e., the channel 702 only spans partially along the longitudinal length 810. The channel 702 may also be accessible from the rear face 700 without any upper or lower access point into the channel 702. The rear adaptor connector 610, namely the channel 702, is operably configured to be selectively removably couplable to the belt connector 200. Said differently, the first and second stanchion connectors 102, 104, namely through the rear adaptor connectors 604, 610, are operably configured to selectively directly couple together in the same stanchion tongue-and-groove locking configuration utilized by the belt connectors 116, 200.

In one embodiment, the stanchion tongue-and-groove configuration is of a slidable configuration, wherein in other embodiments, the stanchion tongue-and-groove configuration is of a torsional configuration or combination of the same and a slidable configuration. The second stanchion connector 104 may also include a front end 612 with a front face 614 opposing the rear face 700 of the second stanchion connector 104. In one embodiment, the first and second stanchion connectors 102, 104 are molded from a single piece of material, e.g., PVC or another substantially rigid material. In other embodiments, they are formed from individual pieces and coupled together.

Referring to FIGS. 5-9, the first magnet 500 is retained by the first stanchion connector 102 and disposed proximal to, and with a first pole facing in a direction toward, the front face 812 of the first stanchion connector 102. The second magnet 502 is retained by the second stanchion connector 104 and disposed proximal to, and with a second pole facing in a direction toward, the front face 614 of the second stanchion connector 104. Said another way, the magnets 500, 502 are located at or near, within approximately 0.25 inches from, the front faces 812, 614 of each of the stanchion connectors 102, 104. The first and second poles of the first and second magnets 500, 502, respectively, are of an opposite polarity to attract one another.

In one embodiment, the first and second magnets 500, 502 are of a neodymium material and beneficially have a magnetic flux density of approximately 0.1-1.5 Tesla. Said differently, the first and second magnets 500, 502 have a magnetic flux density sufficient to resist approximately 51 bf or less longitudinal pull or tensional force before they uncouple with one another. The first and second magnets 500, 502 may be permanent magnets and/or electromagnets (as further discussed herein). In one embodiment, the first and second stanchion connectors 102, 104 may house a single magnet, while in other embodiments, the first and second stanchion connectors 102, 104 house multiple magnets. To effectively house (partially or wholly) the magnets 500, 502, the first and second stanchion connectors 102, 104 may define cavities, e.g., cavity 504, shaped and sized to receive the magnets 500, 502, e.g., rectangular cavities having a length and width of approximately 1"×2.5".

To secure and retain the magnets 500, 502 on the first and second stanchion connectors 102, 104, each of the first and second stanchion connectors 102, 104 may include face plates 506, 508 that are operably configured to be selectively removably couplable to ends 604, 612 of each connector. In one embodiment, the face plates 506, 508 are attached to the respective first and second stanchion connectors 102, 104 using one or more mechanical fasteners, e.g., screws or bolts. Each of the face plates 506, 508 may also define the front faces 812, 614 on each of the first and second stanchion connectors 102, 104 and superimposing the cavities defined thereon. To provide an effective engagement between the first and second stanchion connectors 102, 104, the front faces 812, 614 may be substantially planar as shown in the figures. The front faces 812, 614 on the front ends 604, 612 of the first and second stanchion connectors 102, 104 may also each be respectively defined by an outermost terminal perimeter end surface (represented with lines 510 in FIG. 5) on the front ends 604, 612. In some embodiments, the perimeter edge of one or both of the face plates 506, 508 and/or the front ends 812, 614 may have a continuous or discontinuous flange or groove disposed or defined thereon to facilitate in retaining the first and second stanchion connectors 102, 104 together, thereby ensuring a snug contact and prevent lateral and/or vertical uncoupling of the first and second stanchion connectors 102, 104.

Figure 5:
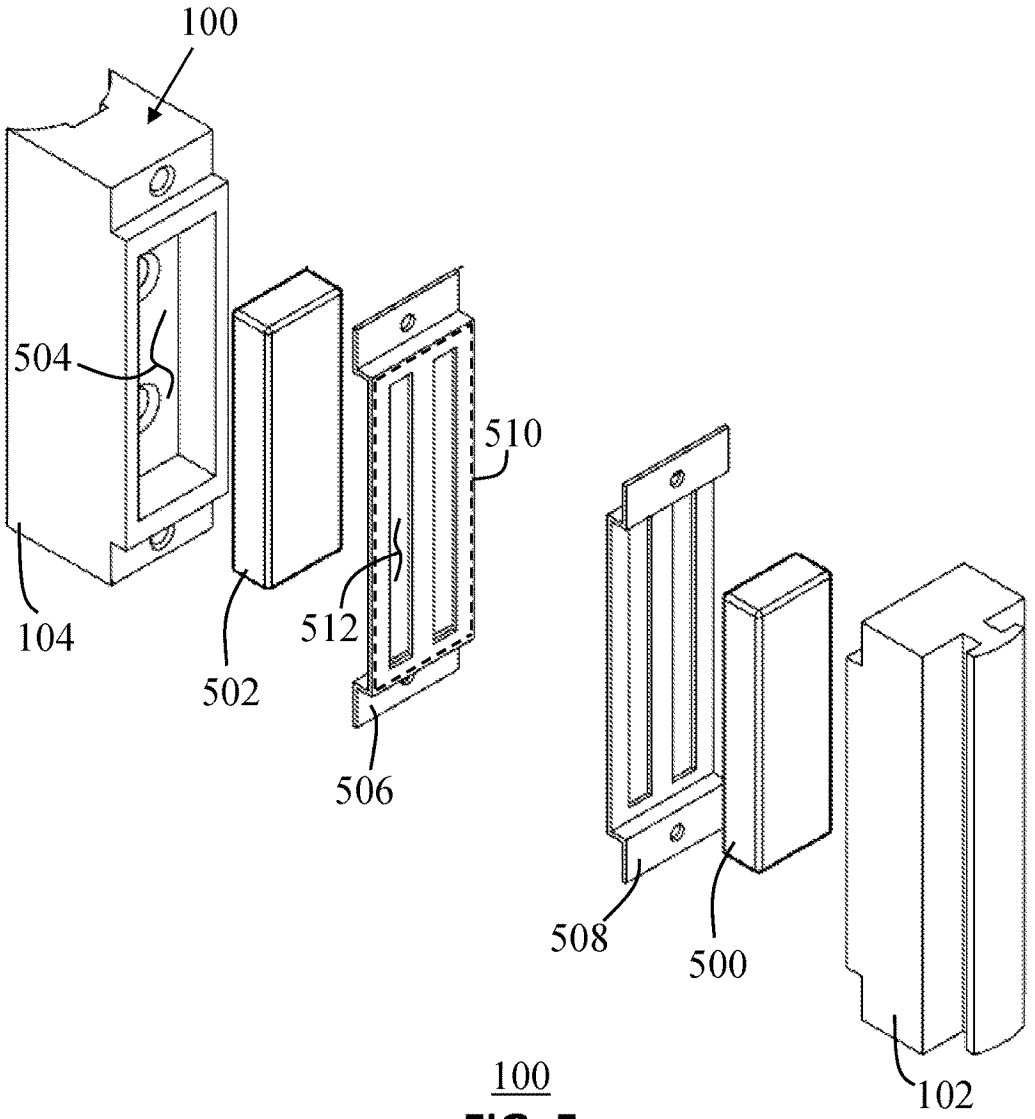
FIG. 5 is an exploded view of a magnetic stanchion connector assembly in accordance with one embodiment of the present invention.
Figure 7:
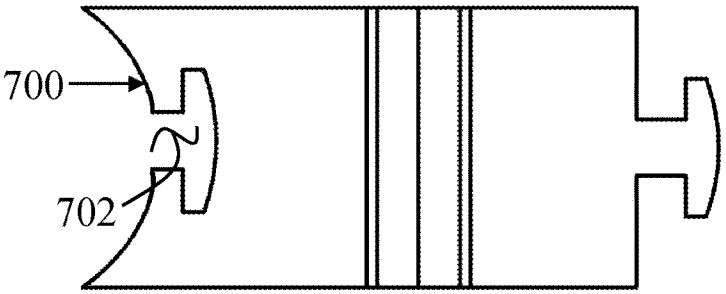
FIG. 7 is a top plan view of the magnetic stanchion connector assembly with a first stanchion connector and a second stanchion connector magnetically coupled together in accordance with one embodiment of the present invention.
Figure 8:
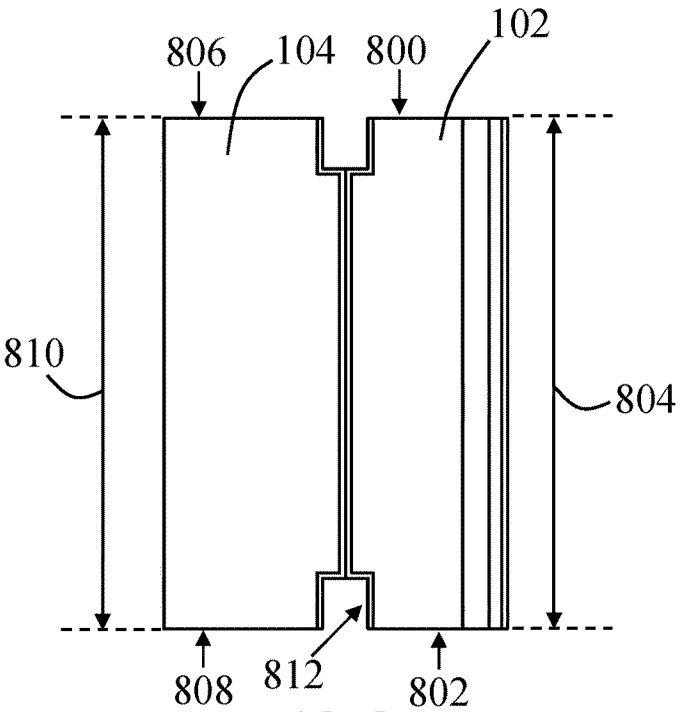
FIG. 8 is an elevational side view of the magnetic stanchion connector assembly with a first stanchion connector and a second stanchion connector magnetically coupled together in accordance with one embodiment of the present invention.
Figure 6:
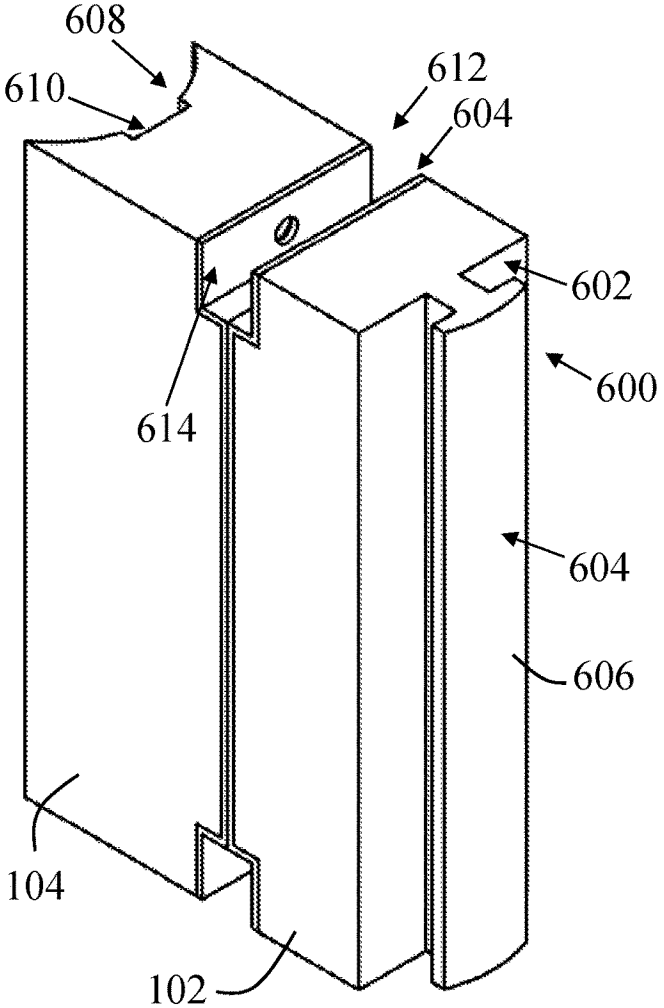
FIG. 6 is a perspective view of the magnetic stanchion connector assembly with a first stanchion connector and a second stanchion connector magnetically coupled together in accordance with one embodiment of the present invention.
Figure 9:
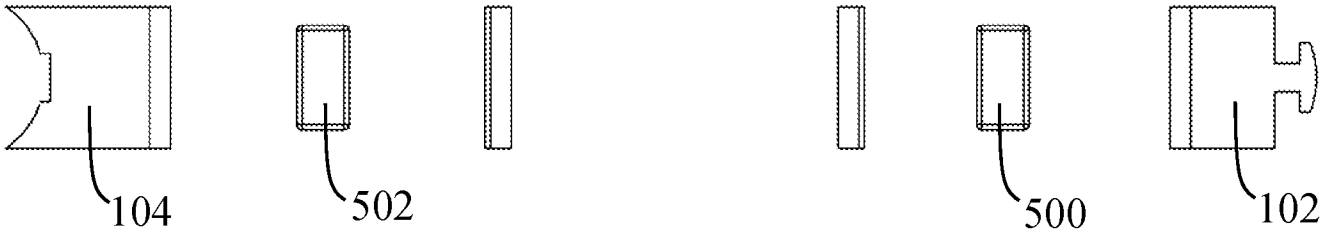
FIG. 9 is an exploded top view of a magnetic stanchion connector assembly in accordance with one embodiment of the present invention.

Each of the face plates 506, 508 may be of a U-shaped configuration selectively removably coupled to the front ends 604, 612 of each of the first and second stanchion connectors 102, 104 with a plurality of mechanical or other fasteners. The U-shaped configuration beneficially permits a majority, if not all, of the magnetic contact surfaces of the first and second stanchion connectors 102, 104 to be the sole contact between them. The face plates 506, 508 may also have at least one channel, e.g., channel 512, spanning a face plate length of the face plate (as best seen in FIG. 5).

Figure 10:
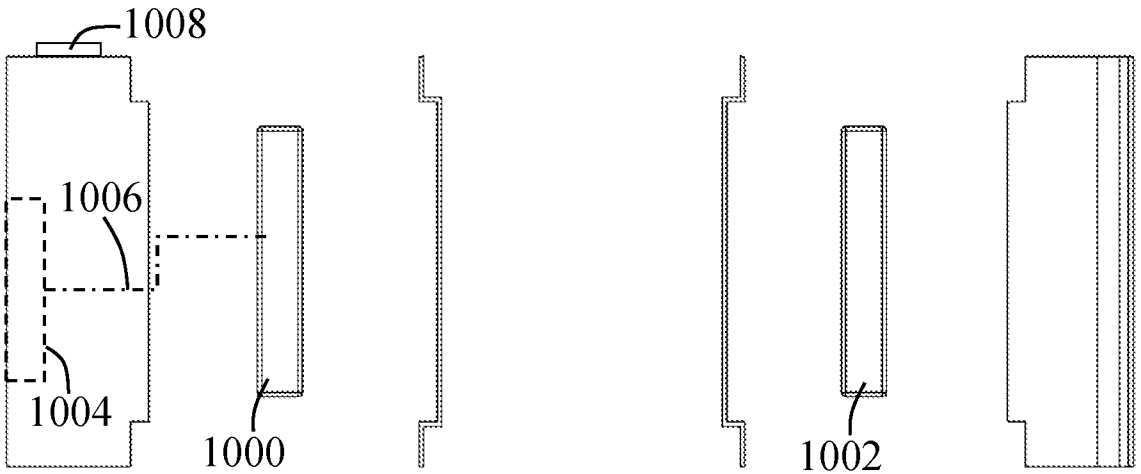
FIG. 10 is an exploded side view of a magnetic stanchion connector assembly in accordance with one embodiment of the present invention.

As best seen in FIG. 10, the first and/or second magnets 1000, 1002 may be an electromagnet 1000 that is electrically coupled to a power source 1004 through, for example, electrical wiring 1006. To activate and/or deactivate the electromagnet 1000, the first and/or second stanchion connectors 102, 104 may include a switch 1008 operably configured to have a first position along a switch translation path completing a circuit and electrically coupling the power source 1004 with the electromagnet 1000. Additionally, the second position along the switch translation path electrically uncouples the power source 1004 with the electromagnet 1000, wherein the power source 1004 may be of a lithium ion battery.

It should be understood that terms such as, "front," "rear," "side," top," "bottom," and the like are indicated from the reference point of a viewer viewing the assembly 100. As used herein, the term "wall" is intended broadly to encompass continuous structures, as well as, separate structures that are coupled together to form a substantially continuous external surface. Additionally, while a specific order of executing process steps has been disclosed, the order of executing the steps may be changed relative to the order shown in certain embodiments. Also, two or more steps shown in succession may be executed concurrently or with partial concurrence in some embodiments. Certain steps may also be omitted for the sake of brevity.

As such, a magnetic stanchion connector assembly has been disclosed that includes a first stanchion connector with one end operably configured to selectively removably couple to a belt end disposed on an extendable and retractable belt and another end with a magnetic surface. Additionally, another second stanchion connector is utilized that includes one end operably configured to selectively removably couple to a belt end disposed on a pole member and another end with a magnetic surface, wherein the two magnetic surfaces are operably configured to selectively, magnetically, and removably couple together.

Various modifications and additions can be made to the exemplary embodiments discussed without departing from the scope of the present disclosure. For example, while the embodiments described above refer to particular features, the scope of this disclosure also includes embodiments having different combinations of features and embodiments that do not include all of the above described features.

What is claimed is:

1. A stanchion connection assembly having an upright first stanchion pole member with a belt with an end having a belt connector disposed thereon that is operably configured to selectively extend and retract with respect to the upright first stanchion pole member and a second stanchion pole member with a second belt connector disposed thereon, the assembly comprising:

a first stanchion connector connected in a tongue-and-groove configuration to the belt connector, and having a rear end with a rear face disposed thereon and with a rear adaptor connector and having a front end with a front face opposing the rear face of the first stanchion connector and with a first magnet retained by the first stanchion connector disposed proximal to, and with a first pole facing in a direction toward, the front face of the first stanchion connector; and a second stanchion connector connected in a tongue-and-groove configuration to the second belt connector, and having a rear end with a rear face disposed thereon and with a rear adaptor connector and having a front end with a front face opposing the rear face of the second stanchion connector and with a second magnet retained by the second stanchion connector and disposed proximal to, and with a second pole facing in a direction toward, the front face of the second stanchion connector, the rear adaptor connectors of the first and second stanchion connectors operably configured to selectively directly couple together and the first and second poles of the first and second magnets, respectively, are of an opposite polarity.

2. The assembly according to claim 1, wherein: the rear adaptor connector of the first stanchion connector is of a male configuration and the rear adaptor connector of the second stanchion connector is of a female configuration.

3. The assembly according to claim 2, wherein: the tongue-and-groove configuration is of a slidable configuration.

4. The assembly according to claim 1, wherein: the first and second magnets are of a neodymium material.

5. The assembly according to claim 1, wherein: the first and second magnets each have a magnetic flux density of approximately 0.1-1.5 Tesla.

6. The assembly according to claim 5, wherein: the front faces on the front ends of the first and second stanchion connectors are each substantially planar.

7. The assembly according to claim 6, wherein: the front faces on the front ends of the first and second stanchion connectors are each respectively defined by an outermost terminal perimeter end surface on the front end.

8. The assembly according to claim 6, wherein the first and second stanchion connectors each further comprise:

a cavity with the first and second magnets, respectively, at least partially housed therein; and a face plate defining the front face on each of the first and second stanchion connectors and superimposing the cavities and magnets housed therein.

9. The assembly according to claim 8, wherein: the face plate is of a U-shaped configuration selectively removably coupled to the front end of each of the first and second stanchion connectors with a plurality of mechanical fasteners, the face plate having at least one channel spanning a face plate length of the face plate.

10. The assembly according to claim 1, wherein the first magnet is an electromagnet and the first stanchion connector further comprises: a power source and a switch operably configured to have a first position along a switch translation path completing a circuit and electrically coupling the power source with the electromagnet and a second position along the switch translation path electrically uncoupling the power source with the electromagnet, wherein the power source is of a lithium ion battery.

11. The assembly according to claim 10, wherein: the second magnet is a permanent magnet.

12. A magnetic stanchion connector assembly comprising:

a first stanchion connector connected in a tongue-and-groove configuration to a belt connector, and having an upper end, a lower end, a connector length separating the upper and lower ends of the first stanchion connector, a rear end with a rear face disposed thereon and with a rear adaptor connector of a male configuration including a locking member disposed on the rear face and spanning along the connector length and having a front end with a front face opposing the rear face of the first stanchion connector and with a first magnet retained by the first stanchion connector and disposed proximal to, and with a first pole facing in a direction toward, the front face of the first stanchion connector; and a second stanchion connector connected in a tongue-and-groove configuration to a second belt connector, and having an upper end, a lower end, a connector length separating the upper and lower ends of the second stanchion connector, a rear end with a rear face disposed thereon and with a rear adaptor connector of a female configuration including a channel disposed on the rear face, corresponding in shape to the locking member of the first stanchion connector, and spanning along the connector length of the second stanchion connector, a front end with a front face opposing the rear face of the second stanchion connector and with a second magnet retained by the second stanchion connector and disposed proximal to, and with a second pole facing in a direction toward, the front face of the second stanchion connector, the first and second poles of the first and second magnets, respectively, are of an opposite polarity.

13. The magnetic stanchion connector assembly according to claim 12, wherein: the tongue-and-groove configuration is of a slidable configuration.

14. The magnetic stanchion connector assembly according to claim 12, wherein:

the first and second magnets are of a neodymium material.

15. The magnetic stanchion connector assembly according to claim 14, wherein:

the first and second magnets each have a magnetic flux density of approximately 0.1-1.5 Tesla.

16. The magnetic stanchion connector assembly according to claim 15, wherein:

the front faces on the front ends of the first and second stanchion connectors are each substantially planar.

17. The magnetic stanchion connector assembly according to claim 16, wherein:

the front faces on the front ends of the first and second stanchion connectors are each respectively defined by an outermost terminal perimeter end surface on the front end.

18. The magnetic stanchion connector assembly according to claim 17, wherein the first and second stanchion connectors each further comprise:

a cavity with the first and second magnets, respectively, at least partially housed therein; and a face plate defining the front face on each of the first and second stanchion connectors and superimposing the cavities and magnets housed therein.

19. The magnetic stanchion connector assembly according to claim 18, wherein:

the face plate is of a U-shaped configuration selectively removably coupled to the front end of each of the first and second stanchion connectors with a plurality of mechanical fasteners, the face plate having at least one channel spanning a face plate length of the face plate.

* * * * *